US005249616A

United States Patent [19]

Yen

[11] Patent Number: 5,249,616

[45] Date of Patent: Oct. 5, 1993

[54] DOUBLE-LAYER WINDOW WITH SHADE ROLLER UNIT FOR REGULATING THE LIGHT

[76] Inventor: Chou Yen, Fl. 4, No. 107, Shiow-Feng St., Chung Ho City, Taipei Hsien, Taiwan

[21] Appl. No.: 954,735

[22] Filed: Sep. 30, 1992

[51] Int. Cl.[5] ..... E06B 3/32

[52] U.S. Cl. ..... 160/98; 160/23.1; 160/310

[58] Field of Search ..... 160/98, 310, 26, 23.1, 160/241, 120

[56] References Cited

U.S. PATENT DOCUMENTS 2,237,566 4/1941 Land ..... 160/98
3,186,473 6/1965 Myers et al. ..... 160/98 X
4,338,996 7/1982 Frank ..... 160/26 X
4,506,720 3/1985 Iwanicki ..... 160/26
4,649,980 3/1987 Kunz ..... 160/26 X
4,766,941 8/1988 Sloop et al. ..... 160/241
4,813,198 3/1989 Johnston et al. ..... 160/241 X

*Primary Examiner*—Blair M. Johnson
*Attorney, Agent, or Firm*—Pro-Techtor International

[57] ABSTRACT

A double-layer window includes a window panel consisted of two transparent panels attached together with a narrow space defined on the inside, and a shade roller unit attached to the window panel on the bottom and controlled by a reversible motor to automatically deliver a shade body into the narrow space by two shade guide-rolls in blocking up the window from the light, or to automatically take up the shade body permitting the light to pass through the window.

2 Claims, 4 Drawing Sheets

DOUBLE-LAYER WINDOW WITH SHADE ROLLER UNIT FOR REGULATING THE LIGHT

BACKGROUND OF THE INVENTION

The present invention relates to a double-layer window which is attached with a shade roller unit, which is controlled to guide a shade into the window for stopping the light or to take up the shade from the window for passing the light.

In order to regulate the light passing through a window, a venetian blind or a shutter or a curtain may be used. When a venetian blind or a shutter or a curtain is used, it shall be installed in the wall or a frame on the wall adjacent to the window. Because the venetian blinds, the shutters and the curtains which are commonly used in building construction are inflammable, their use must be very careful and kept away from fire. Because a venetian blind or a shutter or a curtain may be contaminated easily, it must be regularly washed. Furthermore, a variety of double-layer windows are known and widely in use for the advantage of sound and heat isolating effects. However, because a double-layer window is consisted of two panels attached together with a space defined on the inside, much installation space is required, more particularly when a venetian blind or a shutter or a curtain is attached for regulating the light.

SUMMARY OF THE INVENTION

The present invention eliminates the aforesaid disadvantages. According to the first embodiment of the present invention, a double-layer window is generally comprised of two transparent panels attached together with a narrow space defined on the inside, and a shade roller unit attached to the transparent panels on the bottom and controlled by a reversible motor to automatically deliver a shade body into the narrow space by two shade guide-rolls in blocking up the window from the light, or to automatically take up the shade body permitting the light to pass through the window.

According to a second embodiment of the present invention, two symmetrical shade roller units are respectively attached to two attached transparent panels and alternatively controlled by a respective reversible motor to alternatively move a common shade body back and forth through the transparent panels. The shade body is divided into various sections respectively printed with different patterns and colors for display through the transparent panels.

DETAILED DESCRIPTION OF THE PREFERRED EMBODIMENTS

Figure 1:
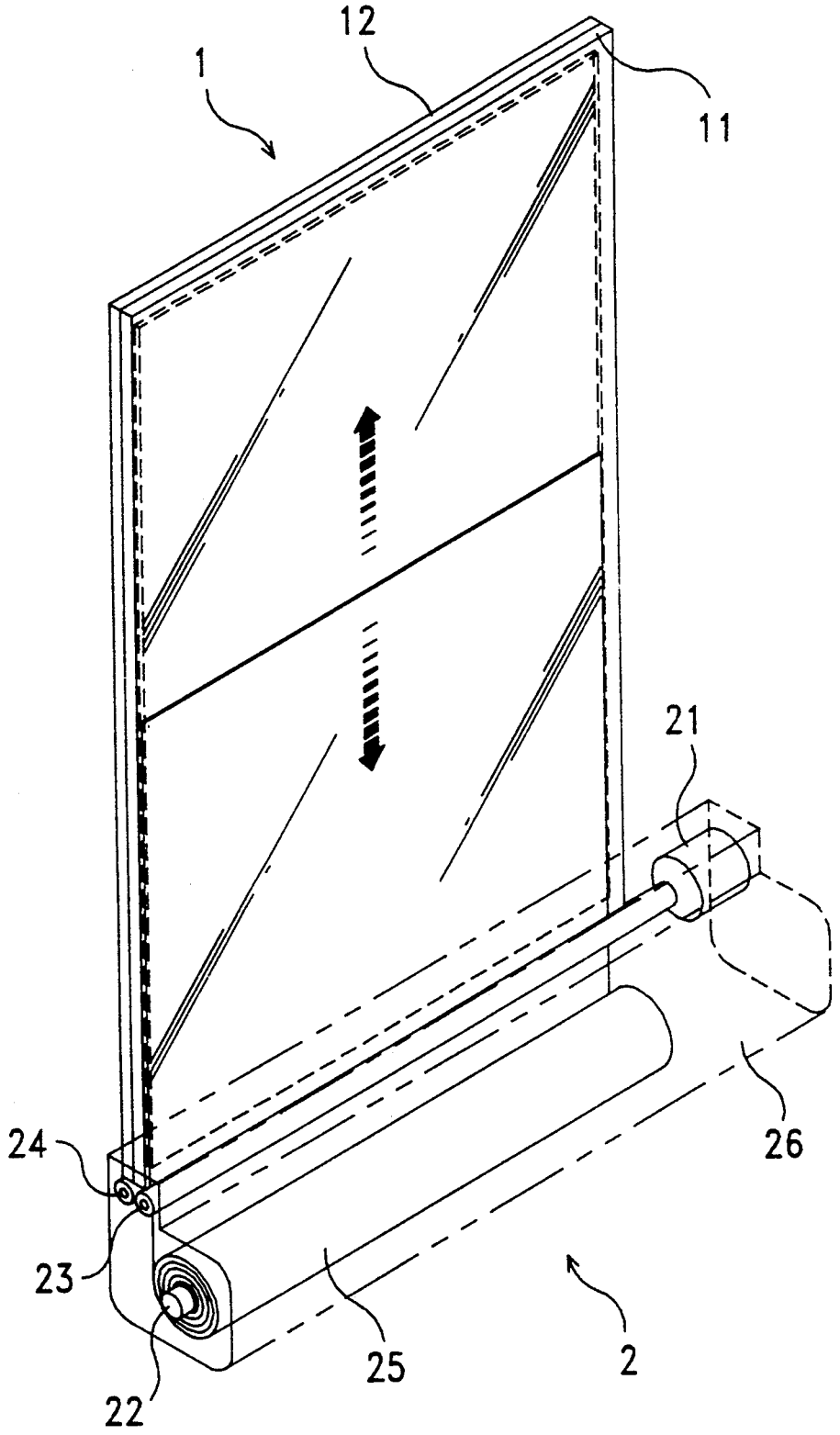
FIG. 1 is a perspective view of a double-layer window embodying the present invention.

Referring to FIG. 1, the present invention is comprised of a shade roller unit 2 attached to a window 1 on the bottom. The window 1 is consisted of a transparent front panel 11 and a transparent rear panel 12 attached together. The border of the front and rear panels 11, 12 is properly sealed, with an elongated opening (not shown) left on the bottom edge thereof. A narrow, flat space about 1 m/m thick is defined inside the window 1 between the transparent front panel 11 and the transparent rear panel 12 in communication with the elongated opening. The shade roller unit 2 is comprised of a reversible motor 21, an auto-return shade roller 22, and a first shade guide-roll 23 and a second shade guide-roll 24. The reversible motor 21 is coupled to either shade guide-roll 23 or 24 on one end and controlled to rotate it against the other shade guide-roll 24 or 23. The auto-return shade roller 22 has a shade 25 wound thereon. The reversible motor 21, the auto-return shade roller 22, the first and second shade guide-rolls 23,24, and the shade body 25 are protected inside a dust guard 26. The shade body 25 is inserted through a very narrow gap between the first and second shade guide-rolls 23,24, having a front end formed into an end flange 251 stopped at in the elongated opening of the window 1 in front of the first and second shade guide-rolls 23,24 and a rear end fixedly fastened to the auto-return shade roller 22. The auto-return shade roller 22 is controlled by a spring (not shown), which automatically takes up the shade body 25.

Figure 2B:
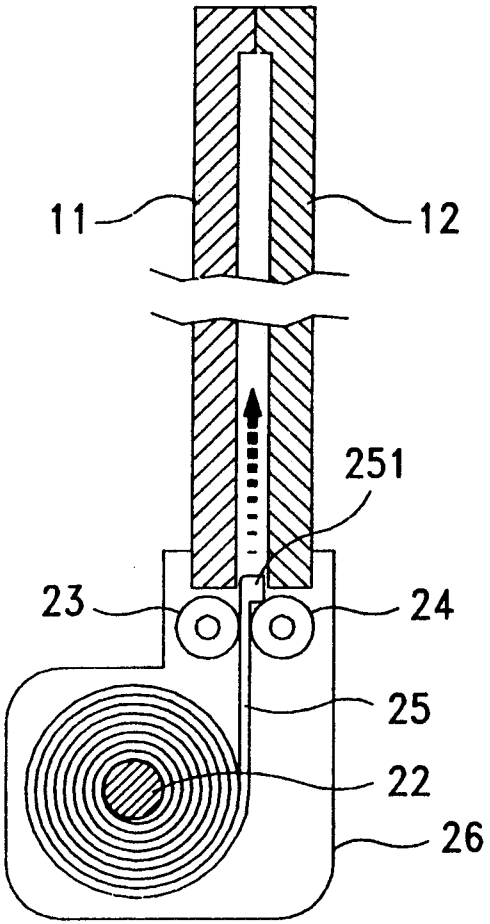
FIG. 2B is another sectional side view thereof showing that the shade roller unit is controlled to let off the shade and guide it into the window.
Figure 2A:
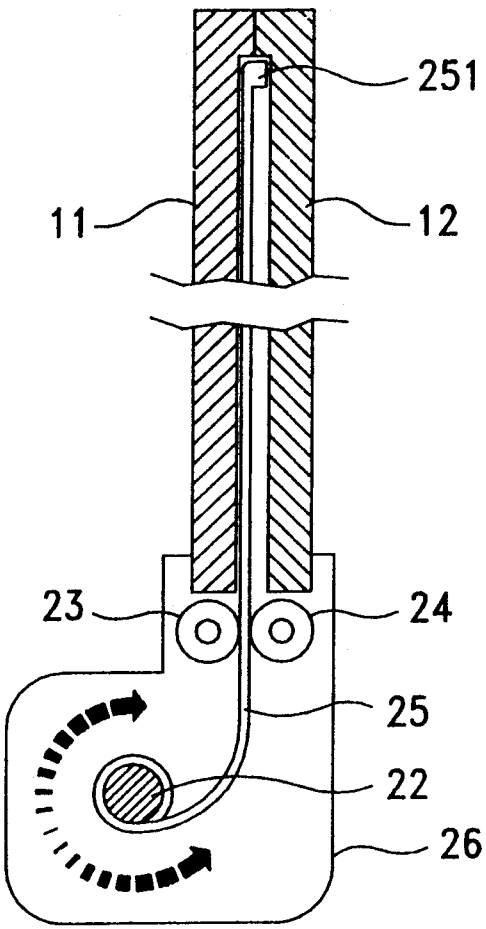
FIG. 2A is a sectional side view thereof showing that the shade roller unit is controlled to take up the shade.

The operation of the present invention is outlined hereinafter with reference to FIGS. 2A and 2B. Rotating the reversible motor 21 in one direction causes the first and second shade guide-rolls 23,24 to be rotated in delivering the shade body 25 into the space between the transparent front panel 11 and the transparent rear panel 12, and therefore the window 1 is blocked up to stop the light from passing through. Rotating the reversible motor 21 in the other direction causes the first and second shade guide-rolls 23,24 to move the shade body 25 backwards, and therefore the shade body 25 is removed from the window 1 and automatically taken up by the shade roller 22. Because the shade body 25 has a front end formed into an end flange 251, it is stopped from passing through the gap between the first and second shade guide-rolls 23,24. The gap between the first and second guide-rolls 23,24 is slightly smaller than the thickness of the shade body 25, and therefore the shade body can be smoothly moved forwards or backwards by the shade guide-rolls 23,24 without being caused to wrinkle.

Figure 3:
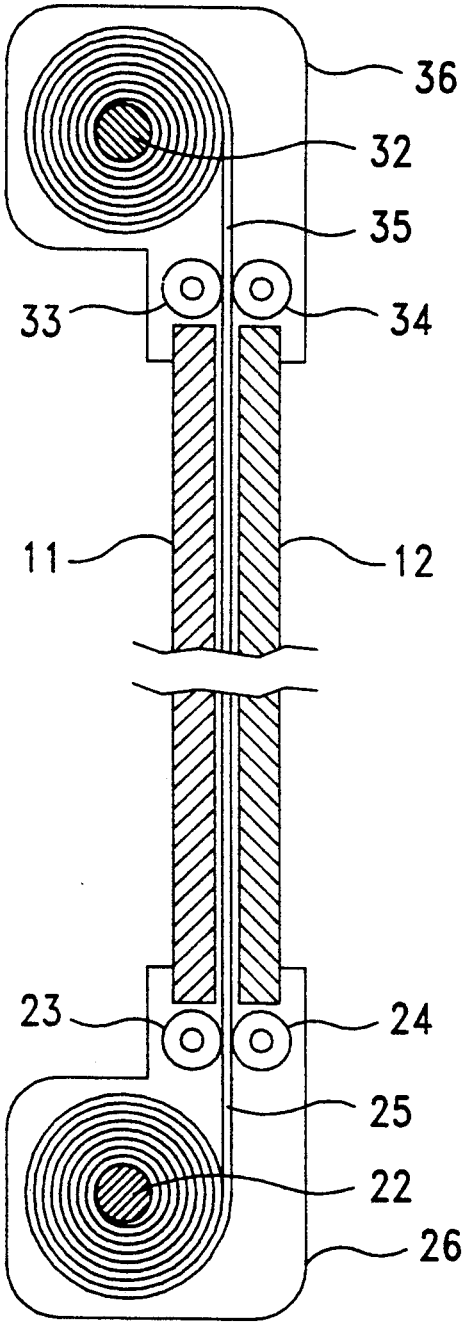
FIG. 3 is a sectional side view of an alternate form of the present invention.
Figure 4:
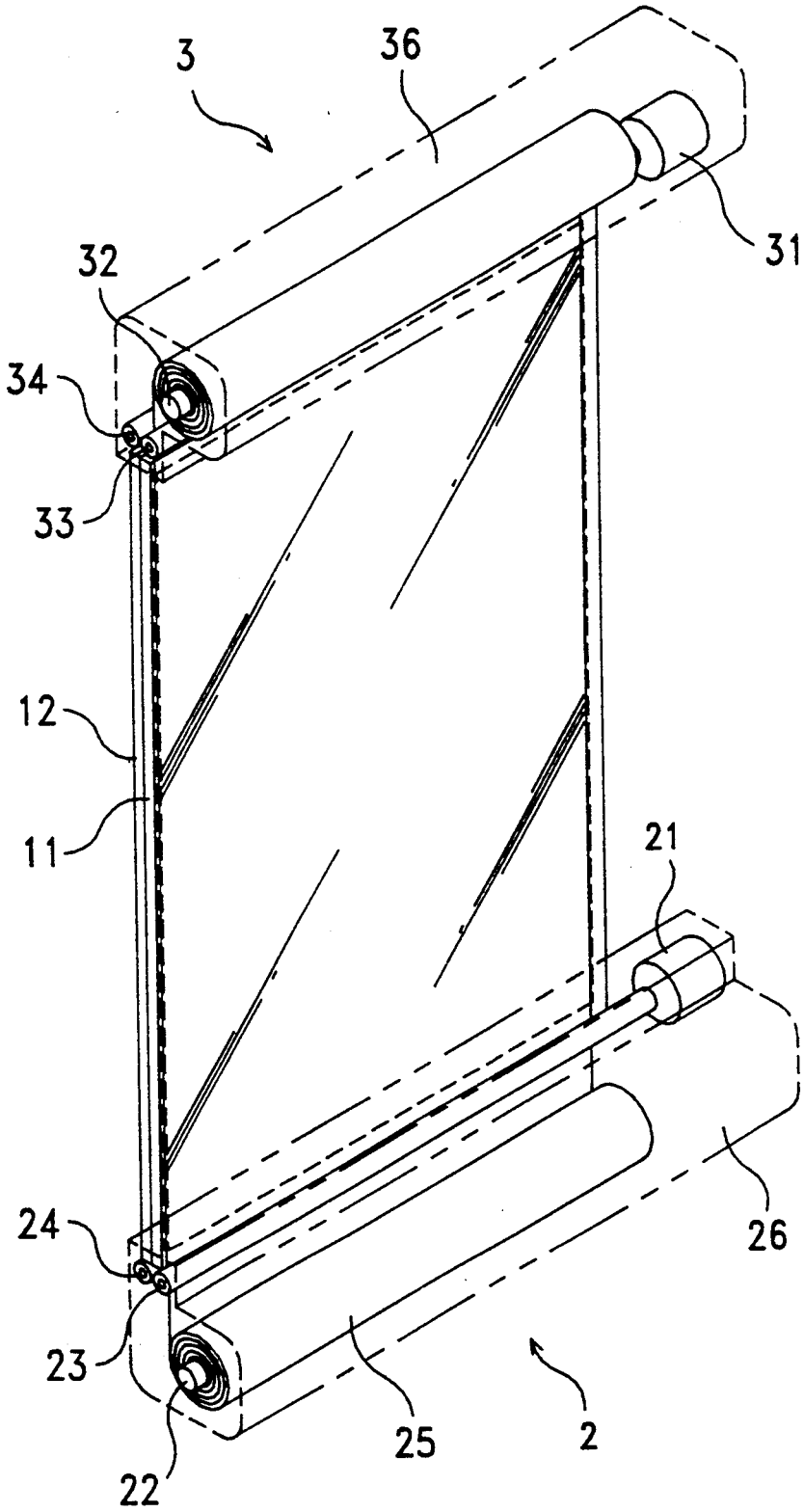
FIG. 4 is a perspective view of the double-layer window of FIG. 3.

Referring to FIGS. 3 and 4, therein illustrated is an alternate form of the present invention. In this alternate form, the top edge of the window 1 is opened for moving the shade body 25 of the shade roller unit 2, and a second shade roller unit 3 is attached to the window 1 on the top. The second shade roller unit 3 is also comprised of a reversible motor 31, an auto-return shade roller 32, a first shade guide-roll 33 and a second shade guide-roll 34. However, the front end of the shade body 25 is fastened to the shade roller 32 of the second shade roller unit 3. Because the shade body 25 has two opposite ends respective connected to the shade roller 22 of the shade roller unit 2 on the bottom and the shade roller 32 of the shade roller unit 3 on the top, it can be alternatively moved back and forth in the window 1 by means of the control of the reversible motors 21 and 31. In this embodiment, the shade body 25 can be made in any of a variety of sheet materials and divided into several sections respectively printed with different colors and patterns for making changes.

What is claimed is:

1. A double-layer window comprising a window panel consisting of a transparent front panel attached to a transparent rear panel with a narrow space defined therebetween, said window panel having an elongated bottom opening communicating with said narrow space; and a shade roller unit attached to said window panel at a lower end thereof and protected by a dust guard, said shade roller unit comprising two shade guide-rolls rotated by a reversible motor to deliver a shade body from a shade roller into said narrow space through said elongated bottom opening in blocking up said window or moving said shade body out of said window permitting it to be automatically taken up by said shade roller, said shade body being inserted through a gap between said shade guide-rolls and having a front end formed into an end flange disposed above said shade guide-rolls and a rear end fastened to said shade roller disposed below said shade guide-rolls.

2. A double-layer window comprising a window panel consisting of a transparent front panel attached to a transparent rear panel with a narrow space defined therebetween, said window panel having an elongated bottom opening on a bottom edge thereof and an elongated top opening on a top edge thereof, said elongated bottom opening and said elongated top opening being respectively communicated with said narrow space, a first shade roller unit attached to said window panel on the bottom and protected by a dust guard, a second shade roller unit attached to said window panel on the top and protected by a dust guard, said first and second shade roller units being each comprised of a reversible motor and a shade roller and two shade guide-rolls, and a shade body inserted through said elongated bottom opening said narrow space and said elongated top opening and having one end inserted through the shade guide-rolls of said first shade roller unit and connected to the shade roller of said first shade roller unit and an opposite end inserted through the shade guide-rolls of said second shade roller unit and connected to the shade roller of said second shade roller unit.

* * * * *